United States Patent [19]

Marchetti

[11] Patent Number: 4,671,440

[45] Date of Patent: Jun. 9, 1987

[54] DEVICE FOR CUTTING AND SETTING A FREE END OF ADHESIVE TAPE IN A PREDETERMINED POSITION ON AN APPLICATOR ROLLER, PARTICULARLY FOR CARDBOARD BOX SEALING MACHINE TAPING UNITS

[76] Inventor: Augusto Marchetti, Piazza Sicilia, 7, 20146 Milano, Italy

[21] Appl. No.: 765,155

[22] Filed: Aug. 13, 1985

[30] Foreign Application Priority Data

Oct. 17, 1984 [IT] Italy ..... 23546/84[U]

[51] Int. Cl.[4] ..... B26F 3/02

[52] U.S. Cl. ..... 225/72; 225/89; 156/523

[58] Field of Search ..... 225/72, 89; 156/523, 156/530

[56] References Cited

U.S. PATENT DOCUMENTS

| | | | |
|---|---|---|---|
| 2,145,506 | 1/1939 | DeMattia | 225/89 X |
| 2,380,258 | 7/1945 | Pasinski | 225/89 X |
| 3,168,231 | 2/1965 | Ronning | 225/89 X |
| 3,463,694 | 8/1969 | DeRoshia | 156/523 |

*Primary Examiner*—James M. Meister

*Attorney, Agent, or Firm*—Cushman, Darby & Cushman

[57] ABSTRACT

A cutting blade is fixed to a supporting frame rotatable about an inlet applicator roller. Locator projections work together to stop said frame in a predetermined angular position, in which the blade carries out the cutting of the adhesive tape on the applicator roller.

3 Claims, 3 Drawing Figures

DEVICE FOR CUTTING AND SETTING A FREE END OF ADHESIVE TAPE IN A PREDETERMINED POSITION ON AN APPLICATOR ROLLER, PARTICULARLY FOR CARDBOARD BOX SEALING MACHINE TAPING UNITS

The present invention relates to a device for cutting and setting a free end of adhesive tape in a predetermined position on an applicator roller, particularly for cardboard box sealing machine taping units.

Sealing machines are known which apply adhesive sealing tapes along the top and bottom of cardboard boxes after the closing flaps of said boxes have been folded into closing position.

To achieve this the aforesaid machines employ automatic taping units placed one underneath and the other above the path of travel of the boxes along a supporting surface and designed in such a manner that the box itself automatically causes withdrawal, cutting and application of the correct length of tape.

Taping units of the conventional type include two gummed applicator rollers placed one at the inlet and the other at the outlet of the taping unit and flexibly stressed to protrude outside the the space occupied by the containing case of the taping unit and inside the path of travel of the boxes but at the same time capable of returning inside said space while the box is passing. A cutting blade is also provided between the two aforesaid rollers with similar features of protruding into and out of the space occupied by the taping unit containing case.

The purpose of the inlet roller is to cause an initial length of tape to adhere to the front wall of the box and then when forced by the box to return within the space occupied by the taping unit case to accompany the tape which follows, pulled by the box, along the adjoining horizontal wall (top or bottom) of the box to the rear wall of said box. When the outlet roller has been passed by the box and thus allowed to go out of the space occupied by the taping unit case it has the purpose of causing a terminal length of tape to adhere to the rear wall of the box. The cutting blade, after being passed by the travelling box, has the purpose of cutting the tape between one box and the next, thereby fixing the length of the final section of tape and of the following initial section of tape for the following box. A problem of these taping units is connected with the initial presetting of the free end of the tape, after cutting of the usual "tail" of nonadhesive material, in a precise and ideal position on the inlet applicator roller where it will then automatically position itself at the end of each tape application and cutting operation.

To accomplish said presetting and the cutting operation which precedes it, a manual operation is used at present and is, of course, a source of considerable inaccuracy. Otherwise a dangerous cutting operation using the cutting blade of the taping unit is performed.

The object of the present invention is to accomplish a device which, in association with an applicator roll of adhesive tape, in particular for cardboard box sealing machine taping units, makes it possible to accomplish the cutting and first setting of the free end of the tape in a precise and repeated position on the surface of the aforesaid applicator roller.

In accordance with the invention said object is achieved with a device characterized in that it comprises a cutting blade fixed to a supporting frame rotatable around the applicator roller, there being provided locator projections working together to stop said frame in a predetermined angular position which establishes a desired cutting position for said blade.

With an extremely simple device it is thus made possible to cut and then preset the free end of a tape in a precise position on said applicator roller.

There is no approximation nor possibility of error and any operator can be sure to have preset the tape in the correct and constantly repeated position of the beginning of work.

The features of the present invention will be made clearer by the following detailed description of a preferred practical embodiment thereof illustrated by way of example in the annexed drawings wherein FIG. 1 shows a partially sectional side view of a taping unit with inlet applicator roller fitted with a cutting device and preset in accordance with the present invention;

Figure 1:
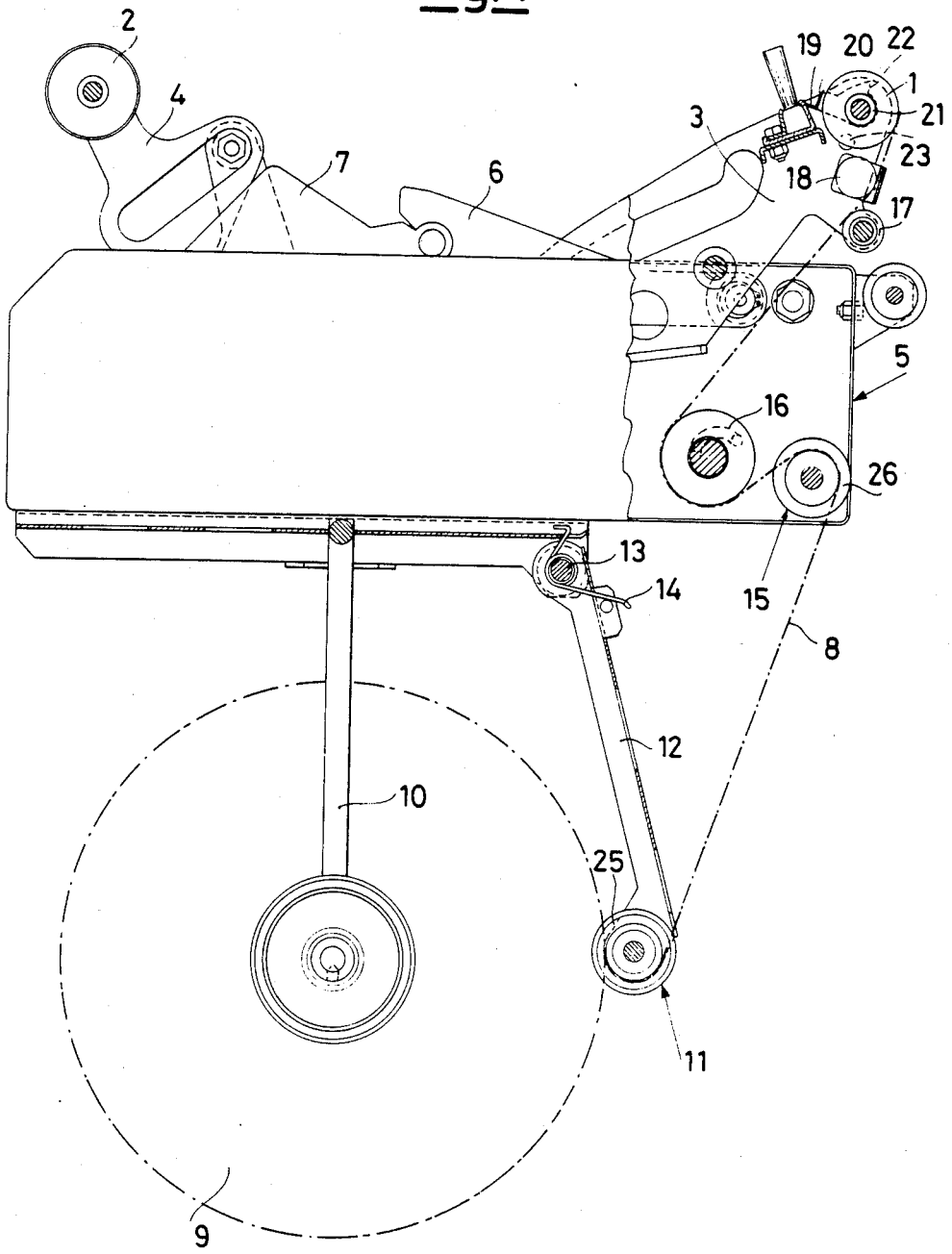

With reference to FIG. 1 a cardboard box sealing machine taping unit is shown therein which includes as usual an inlet applicator roller 1 and an outlet applicator roller 2 mounted in a revolving manner on their respective supports 3 and 4 stressed flexibly to protrude from a containing housing 5 but also capable of returning inside said housing under the stress of a box advancing on the top of the housing 5 from right to left as viewed in FIG. 1. Also provided is a cutting blade (not shown) which also has levered drive mechanisms 6 and 7 which can be engaged by the bottom of the box.

In the aforesaid taping unit an adhesive tape 8 is unwound from a roll 9 and made to reach to a preset position on the surface of the inlet applicator roller 1.

The roll 9 is supported in a revolving manner by an arm 10 which extends downward from the bottom of the housing 5. From said housing the tape 8 is unwound with the aid of a withdrawal and centering roller 11 fitted with sides 25 which is mounted in a revolving manner on a supporting arm 12 pivoted at 13 on the housing 5 and stressed toward the roll 9 by a spring 14. The unrolled tape is then made to reach the applicator roller 1 after engaging with the idling rollers 15, 16, 17 and 18 of which the first two are mounted in a revolving manner on the housing 5 and the other two are mounted in a revolving manner on the support 3 of the applicator roller 1. The idling roller 15 is fitted with sides 26 of which the purpose is centering and the idling roller 16 is the unidirectional type, i.e. it allows unwinding but not rewinding of the tape 8.

Figure 2:
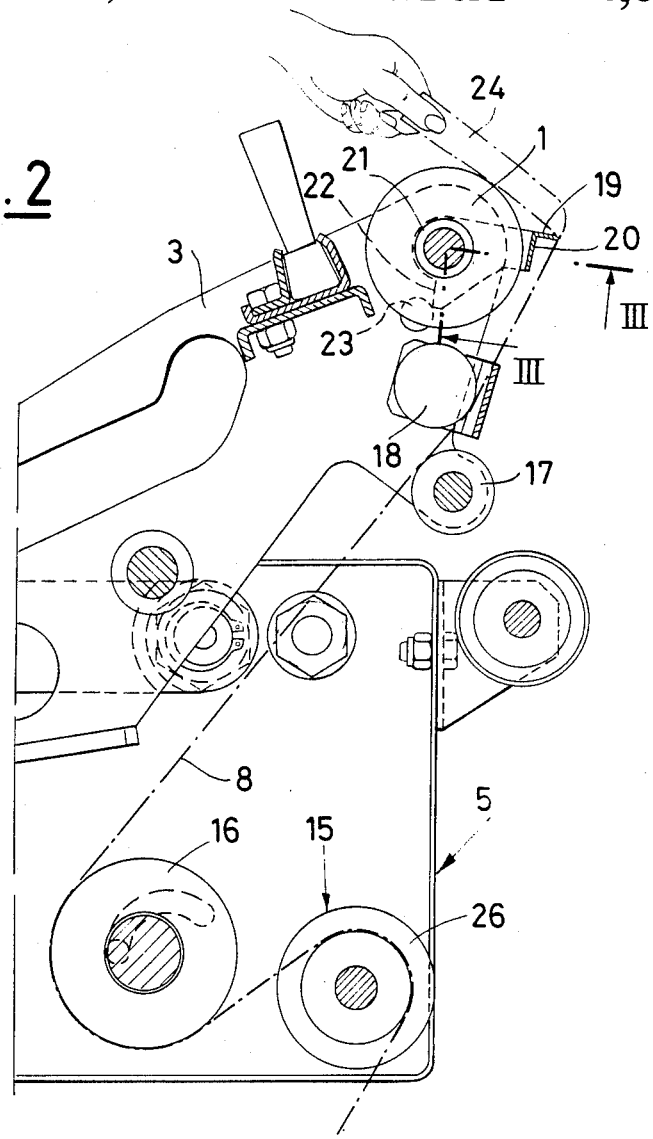
FIG. 2 shows in enlarged scale the inlet part of said taping unit with said device in position to cut thc free end of the tape.
Figure 3:
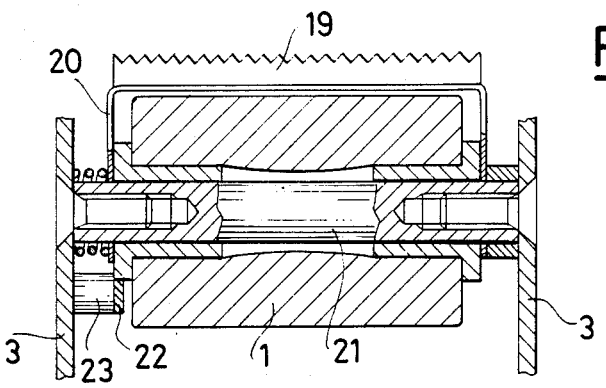
FIG. 3 shows said device further enlarged in a detailed cross sectional view along plane III—III of FIG. 2.

As further shown in FIGS. 2 and 3, with the applicator roller 1 is associated a device for cutting and presetting the free end of the tape which comprises a cutting blade 19 fixed on a revolving support frame 20 mounted on the same rotation pin 21 as the applicator roller 1.

The revolving frame 20 and the cutting blade 19 are normally held in the neutral position shown in FIG. 1 in which they do not interfere with the normal operation of the taping unit.

When it is desired to make the cut and the initial presetting of the free end of the adhesive tape 8 the revolving frame 20 may be rotated to the angular operating position shown in FIG. 2 which is established by the engagement of a nib 22, which protrudes from the frame 20, with a fixed catch projection 23 which is integral with the support 3 (FIG. 3).

In said position the cutting blade 19 can cut off the free end of the tape 8 stretched by the operator by means of the usual "tail" 24 of nonadhesive material (FIG. 2) at a fixed distance from the top of the housing 5, i.e. from the plane of travel of the boxes.

After performance of the cut and return of the blade 19 to neutral position as shown in FIG. 1 it is apparent that the cut end of the tape takes a precisely determined position on the surface of the roller.

I claim:

1. In a carton sealing machine: means for mounting a roll of adhesive tape for rotation about its axis; an inlet tape applicator roller mounted for rotation about its axis for receiving tape from a roll of tape on said mounting means whereby there is a normal path of travel between said mounting means and said inlet roller during operation of the machine; an outlet applicator roller mounted for rotation about its axis; and a device for manually cutting a nonadhesive tail from a leading end of a length of tape from a new roll of tape and for pressing the resulting free end of the tape in a predetermined position on the inlet applicator roller so that normal operation of the machine may occur, said device including a frame mounted for independent rotation about the axis of said inlet applicator roller and a cutting blade fixed to said frame, the arrangement being such that upon rotation of said frame said cutting blade can move toward and away from said path of tape travel, said device further including stop means for stopping said frame in a predetermined operative position in which said blade is in a desired tape-cutting position adjacent said path of tape travel, whereby a nonadhesive tail can be cut from a leading end of a length of tape by manually grasping such tail and applying the tape to said blade to cut the tape and whereby said frame and blade may be rotated to an inoperative position.

2. A taping unit as in claim 1 wherein said frame is rotatably mounted on a pin which also constitutes a pivot pin for said roller.

3. A taping unit as in claim 2 wherein positioning means include a nib protruding from said frame and a fixed projection on a support for said pin.

* * * * *